US006135745A

United States Patent [19]

Blasingame

[11] Patent Number: 6,135,745

[45] Date of Patent: Oct. 24, 2000

[54] VANE ACTUATION MECHANISM FOR AN AXIAL VANE ROTARY DEVICE

[75] Inventor: Thomas W. Blasingame, Boise, Id.

[73] Assignee: T. W. Blasingame Company, Inc., Boise, Id.

[21] Appl. No.: 09/328,523

[22] Filed: Jun. 9, 1999

[51] Int. Cl.[7] ..... F04C 18/00

[52] U.S. Cl. ..... 418/219; 418/228; 418/229; 418/230; 418/231; 418/152; 418/261

[58] Field of Search ..... 418/219, 228, 418/229, 230, 231, 152, 261

[56] References Cited

U.S. PATENT DOCUMENTS

| | | | |
|---|---|---|---|
| 570,584 | 11/1896 | White . | |
| 2,688,385 | 9/1954 | McLaughlin et al. . | |
| 3,033,122 | 5/1962 | Krawacki | 418/219 |
| 3,204,567 | 9/1965 | Krawacki . | |
| 4,004,556 | 1/1977 | Pfeiffer . | |
| 5,429,084 | 7/1995 | Cherry et al. | 418/219 |

FOREIGN PATENT DOCUMENTS

| | | | |
|---|---|---|---|
| 0106985 | 4/1989 | Japan | 418/219 |
| 0247784 | 10/1989 | Japan | 418/219 |

*Primary Examiner*—Thomas Denion
*Assistant Examiner*—Theresa Trieu
*Attorney, Agent, or Firm*—Zarley, McKee, Thomte, Voorhees & Sease

[57] ABSTRACT

A vane actuation mechanism for an axial vane rotary device includes a cylindrical outer housing that defines an internal cylindrical chamber. A rotor assembly having a drive shaft is rotatably mounted within the internal cylindrical chamber. A cylindrical guide slot is held in proper rotational position within the internal cylindrical chamber. A plurality of modified vanes are disposed on the rotor core. The modified vane has a recess in the top of the vane. A shear block having a general "T" shape is disposed in the recess of the vane and is secured to the vane. Part of the shear block is disposed within the guide slot to act as a guide member. The guide slot can be formed from a single cylindrical member. The single cylindrical member is cut to form two cylindrical guide slot members. The edges of the cylindrical guide slot members form the guide slot. The guide slot urges the shear block as the vanes rotate.

14 Claims, 6 Drawing Sheets

VANE ACTUATION MECHANISM FOR AN AXIAL VANE ROTARY DEVICE

BACKGROUND OF THE INVENTION

A. Field of the Invention

The present invention relates to an axial vane rotary device. More particularly, the present invention relates to a shear block and guide slot that are used to actuate the vane in an axial vane rotary device.

B. Problems in the Art

A typical axial vane rotary device of the prior art (e.g. U.S. Pat. No. 5,429,084) includes a stator with a cylindrical internal chamber having an annular outer wall and two side walls. Each side wall has an annular cam surface. A rotor is rotatably mounted within the chamber. The rotor has an annular outer wall and a plurality of singularly spaced apart, axially extending slots extending therethrough. A vane is slidably received in each slot. The vanes reciprocate axially and alternatively expand and compress spaces between adjacent vanes and the cam surfaces as the rotor rotates. The cam surfaces have alternating first portions and second portions. The second portions are further from the rotor than the first portions. The first portions of one cam surface are aligned with second portions of another cam surface at the opposite end of the device. The slots extend radially outwards on the rotor to the outer wall thereof. The outer end of each vane slidably engages the annular outer wall of the stator. The outer wall of the stator may have a guide cam and the vanes may have a follower received by the guide cam. The guide cam is shaped to cause the vanes to reciprocate axially with respect to the rotor as the rotor rotates. Each of the vanes may have resiliently biased first seals extending along the inner edge and second seals along side edges thereof.

The above prior art device utilizes a pin projecting from the vane, equipped with an anti-friction shoe, as the follower that is received by the guide cam. This arrangement functions adequately when the rotary device rotates at slow speeds and when the mass of the vane is relatively small. However, when the axial vane rotary device is operated at high speeds, or a vane of large mass is used, large shear forces develop which cause the pin, or the pin and shoe combination, to break. The breaking of the pin allows the vane to forcefully contact the annular walls of the stator, resulting in even greater damage to the axial vane rotary device. There is a need for a guide member that can withstand large shear forces without fracturing.

In addition, the guide slot in the above prior art device is machined into the inner surface of the stator. This is a difficult position in which to machine the slot. It is also difficult to repair the guide slot in the event of wear or other damage.

Therefore, it is a primary objective of the present invention to provide an improved guide member and guide slot that solve problems and deficiencies in the art.

It is a further object of the present invention to provide a shear block as a guide member that can withstand the large shear forces that are present when the axial vane rotary device is operated at high speeds or when the vane has a relatively large mass.

A still further object of the present invention is to provide a guide slot that reduces contact pressure on the guide member.

A still further object of the present invention is to provide a guide slot having members that are easy to remove and replace.

A still further object of the present invention is to provide a guide slot and shear block that are economical to manufacture and durable in use.

These and other objects will be apparent to those skilled in the art.

SUMMARY OF THE INVENTION

The present invention of a vane actuation mechanism for an axial vane rotary device includes a cylindrical outer housing which defines an internal cylindrical chamber. Within the internal cylindrical chamber, a rotor core having a drive shaft is rotatably mounted. The rotor assembly is configured to provide radial slots parallel to the driveshaft centerline, which maintain the alignment of a plurality of modified axially reciprocating vanes. A two-piece cylindrical member, held in proper rotational position within the internal cylindrical chamber, forms a guide slot. Shear blocks attached to the outer edges of the modified vanes are located in this guide slot, and as the rotor assembly rotates, the shear blocks urge the vanes to reciprocate axially in a controlled manner. A plurality of the modified vanes thus reciprocate in the radial slots of the rotor assembly. Each modified vane has a recess. The recess receives a shear block, preferably "T" shaped in crosssection, which is secured to the vane. The top portion of the shear block is at least partially disposed within the guide slot. The guide slot may be machined into the internal wall of the outer housing.

In an alternative embodiment, the improvement consists of a new guide slot. The guide slot is formed by cutting a single cylindrical member into two cylindrical guide slot members. The edges of the two cylindrical guide slot members form the guide slot. The modified vane having a recess and a shear block disposed in the recess can be used with the improved guide slot.

DETAILED DESCRIPTION OF THE PREFERRED EMBODIMENT

Figures 1A, 1B, 1C:
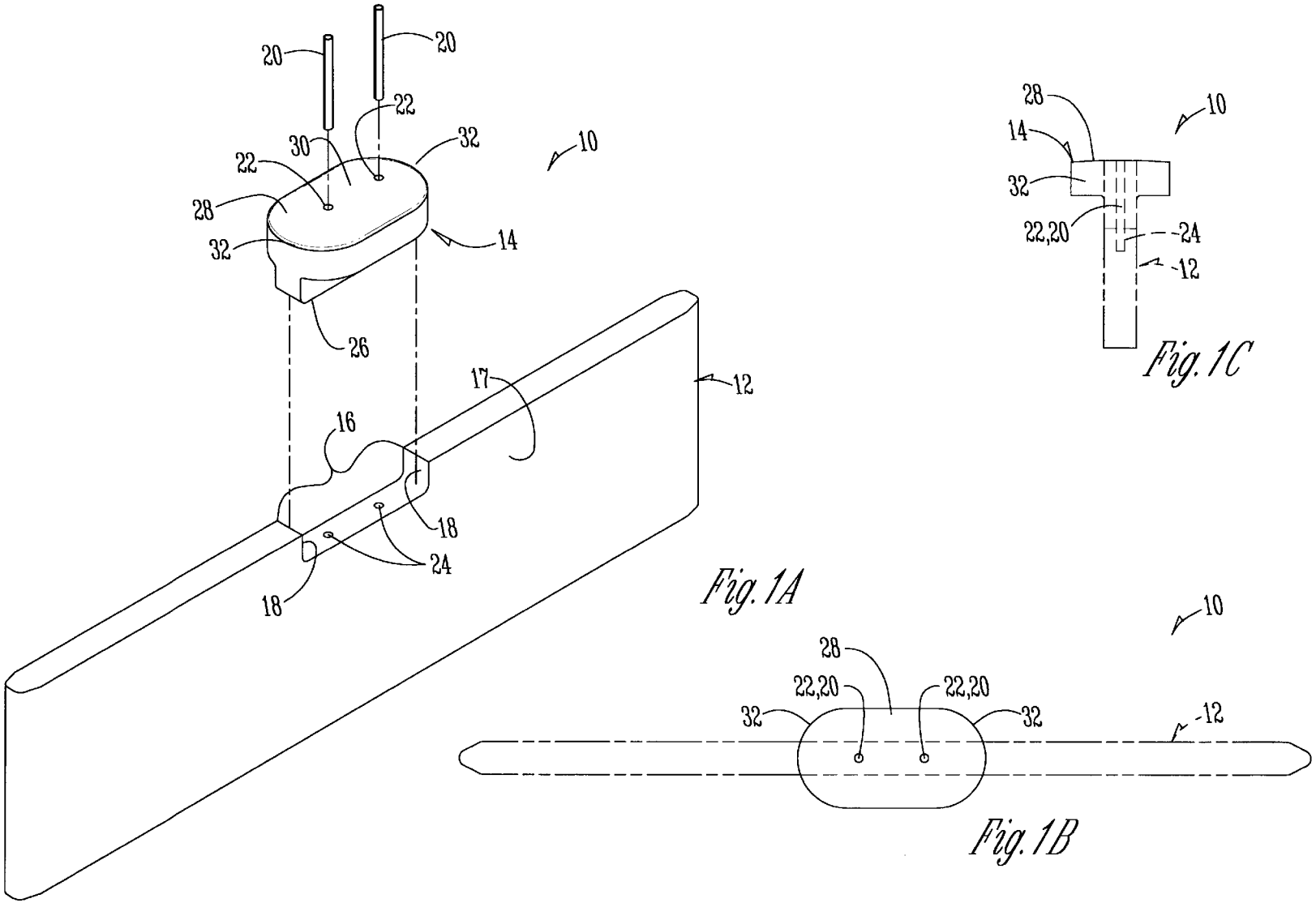
FIG. 1A is a perspective view of the modified vane and shear block of the present invention, shown with the shear block apart from the vane.
FIG. 1B is a top plan view of the modified vane and shear block of the present invention.
FIG. 1C is an end elevation view of the modified vane and shear block of the present invention, with the vane shown in phantom lines.
Figure 3:
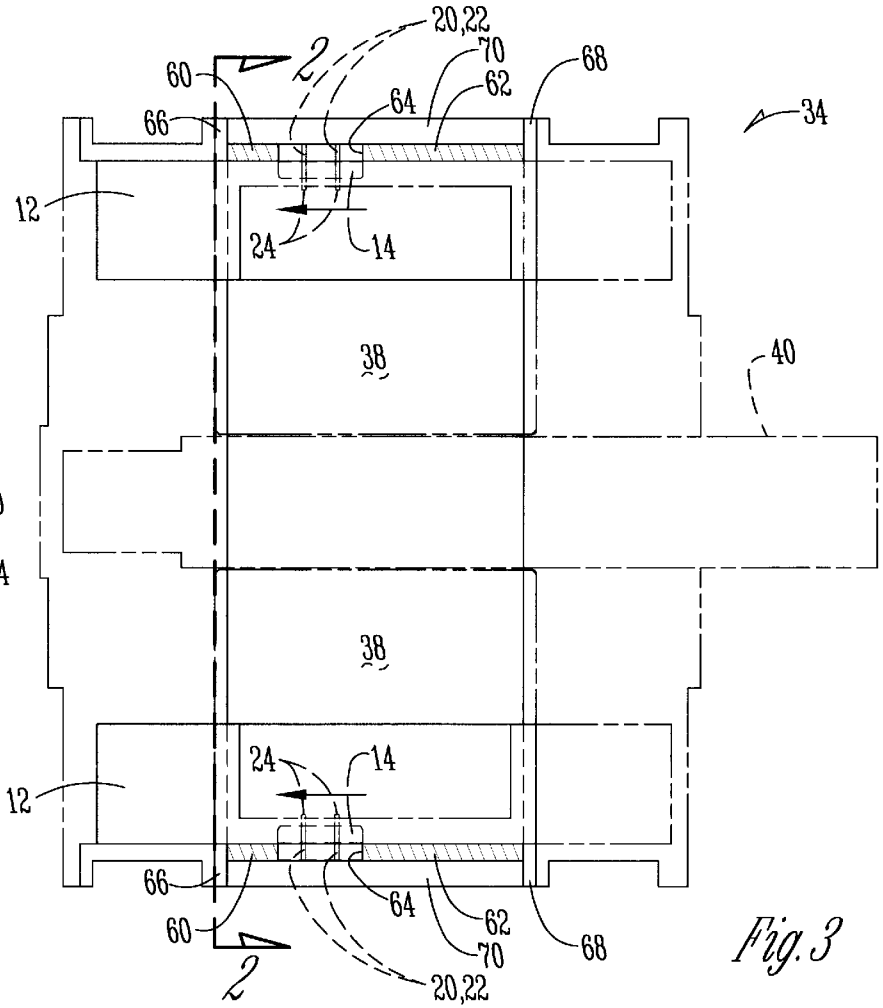
FIG. 3 is a sectional view of an axial vane rotary device of the present invention, taken along line 3—3 of FIG. 2.

To provide a better understanding of the invention, one preferred embodiment of the invention will now be described in detail. It is to be understood that the preferred embodiment discussed below is but one form the invention can take and is not exclusive. The description will make frequent references to the accompanying drawings. Reference numerals and/or letters will be utilized to indicate certain parts or locations in the drawings. The same reference numbers and/or letters will be used to indicate the same parts or locations in all of the drawings unless otherwise indicated.

Figure 2:
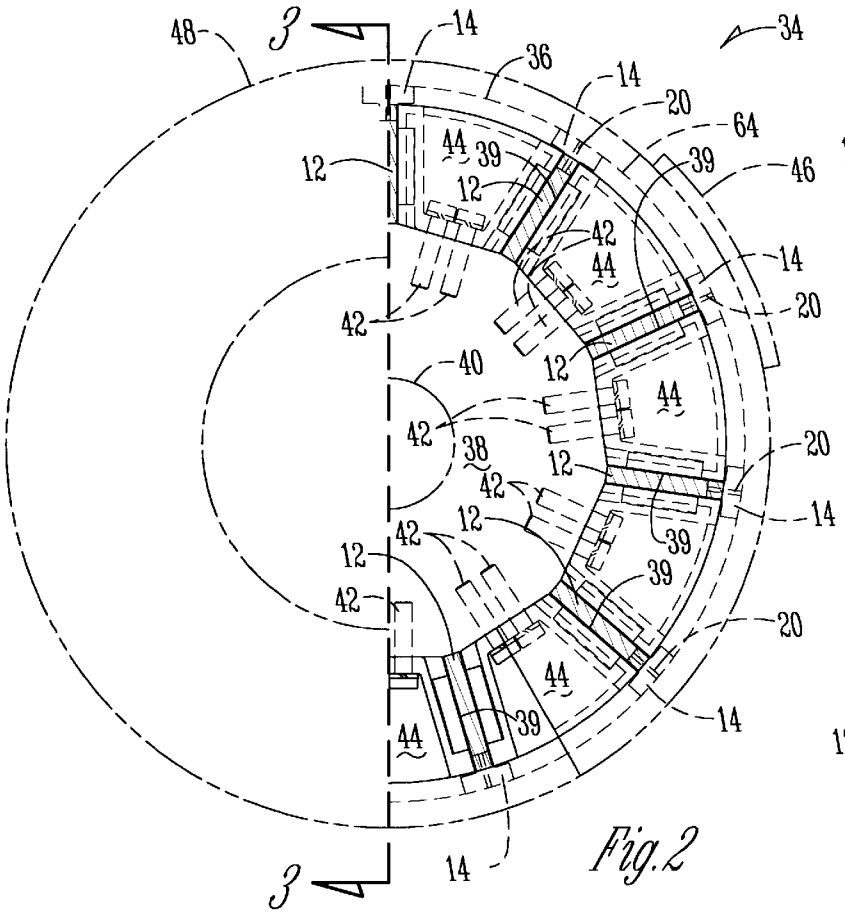
FIG. 2 is a half front view and half sectional view of an axial vane rotary device of the present invention, taken along line 2—2 of FIG. 3.
Figure 5:
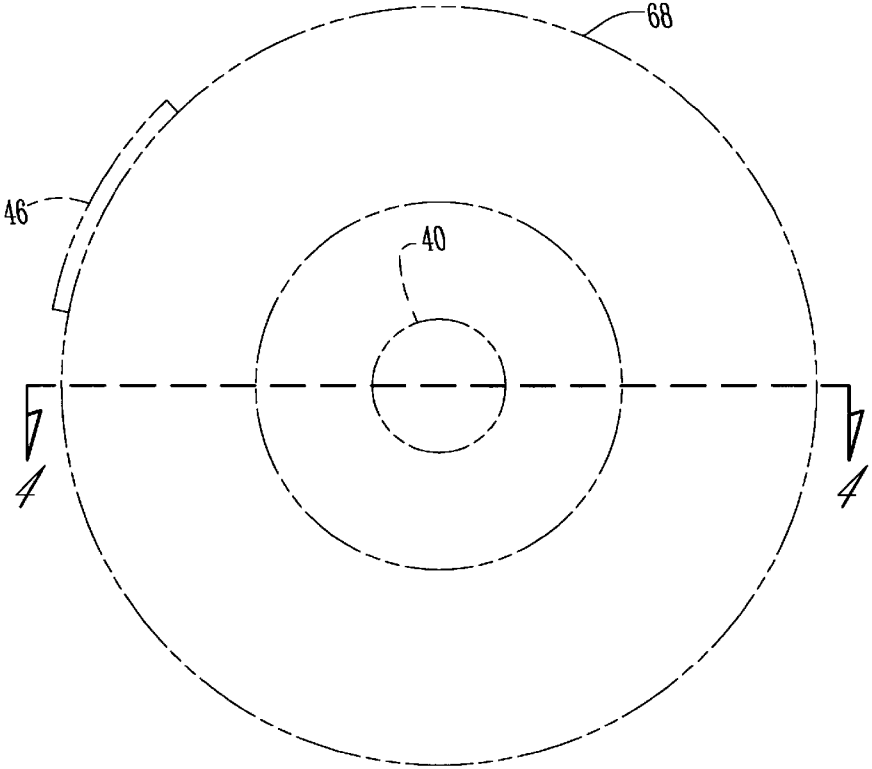
FIG. 5 is an elevational view of an axial vane rotary device of the present invention, showing the end of the drive shaft.
Figure 4:
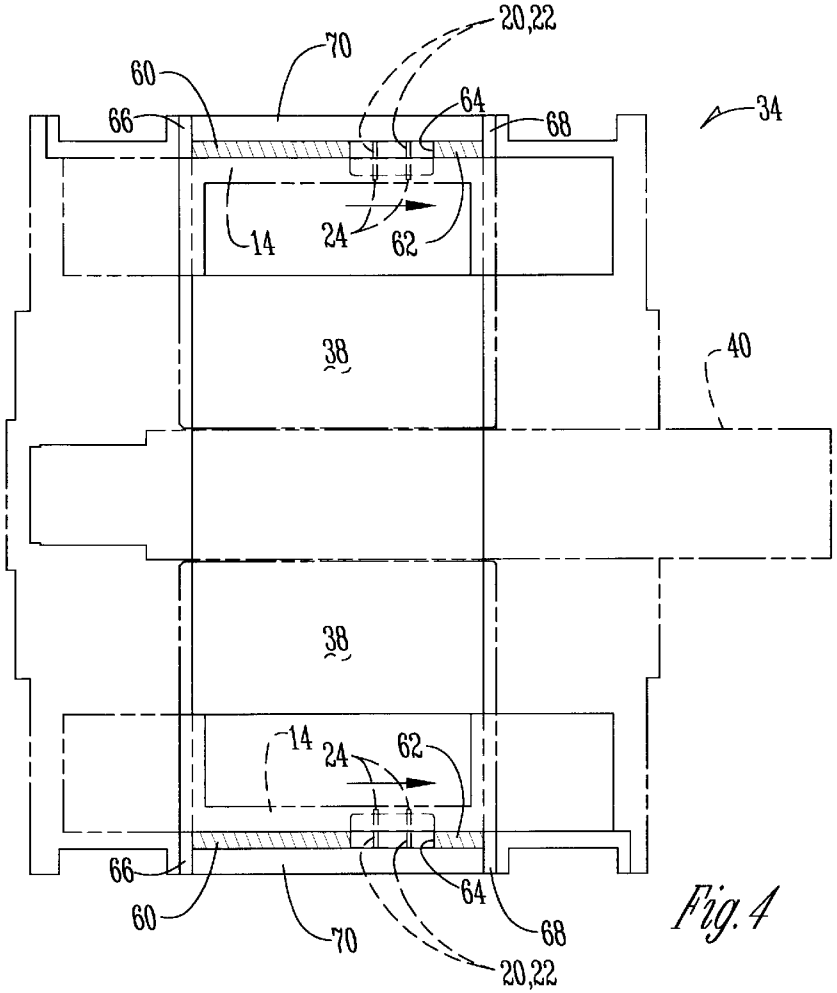
FIG. 4 is a sectional view of an axial vane rotary device of the present invention, taken along line 4—4 of FIG. 5.

A half front view and half sectional view of the axial vane rotary device 34 of the present invention is shown in FIG. 2. The operation of the axial vane rotary device has previously been described in U.S. Pat. No. 5,429,084 and U.S. provisional application Ser. No. 60/068,804, filed Dec. 24, 1997, both of which are incorporated herein by reference. Because the axial vane rotary device has been thoroughly discussed in these two references, only a brief discussion of the device will be given here.

This half-sectional view (FIG. 2) shows a rotor core 38 and segmental individual rotor end blocks 44 which are attached to the rotor core 38 by means of fasteners 42. In the assembly of the axial vane rotary device of the present invention, the drive shaft 40 with rotor core 38 is installed in the cylindrical internal chamber 36. Vane and rotor access cover 46 is not secured to the cylindrical internal chamber 36, as it is required to be removed for access. Through the opening in the cylindrical internal chamber 36 made possible by vane and rotor access cover 46, a segmental individual rotor end block 44 is secured to the rotor core 38 by a plurality of fasteners 42 and properly torqued. Then a vane assembly 10 comprised of a vane 12 and a shear block 14 is set in place on the rotor core 38 adjacent the previously installed segmental individual rotor end block 44. The remaining vane assemblies 10 and segmental individual rotor end blocks 44 are installed in the same manner. The rotor access cover 46 is secured to the outer housing 48 of the axial vane rotary device 34. The spaces 39 between adjacent rotor end blocks 44 form a plurality of radial slots that receive and support the vane assemblies 10. Rather than being a separate construction wherein the rotor end blocks 44 are attached to the rotor core 38, the end blocks 44 could be integral with the rotor core 38.

Most of the previously described axial vane rotary device is conventional. The improvement to the axial vane rotary device lies in (1) the combination of the modified vane and shear block; and (2) the improved guide slot.

Figure 6:
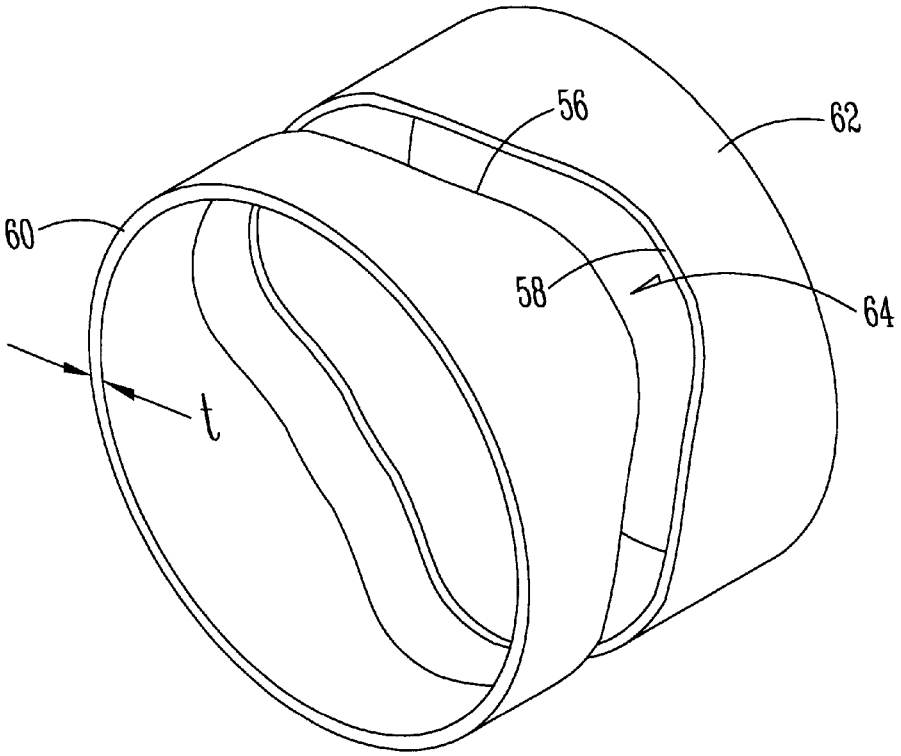
FIG. 6 is a perspective view of the guide members and guide slot of the present invention, showing the guide slot separate from the axial vane rotary device.

A perspective view of the vane assembly 10 comprised of the modified vane 12 and shear block 14 is shown in FIG. 1A. The vane 12 has a recess 16 in the top portion 17 of the vane 12. The recess 16 is designed to receive the shear block 14. In FIG. 1A the shear block 14 is not disposed in the recess 16, but in operation the shear block 14 will be disposed in the recess 16. The vane 12 is preferably made of a light material. The shear block 14 is preferably made of light-weight, shear-resistant and self-lubricating material. The recess 16 is located on the center line of the vane 12. The recess 16 provides vertically oriented surfaces 18 for the shear block 14 to urge laterally as the shear block 14 is guided by the guide slot 64 (FIG. 6).

The shear block 14 fits into the recess 16 of the vane 12. Spring pins 20, or some other type of securing means, may be used to attach the shear block 14 to the vane 12. The spring pins 20 are inserted through holes 22 in the shear block 14. The spring pins 20 are long enough to extend all the way through the shear block 14 and into the holes 24 of the vane 12. The spring pins 20 help secure the shear block 14 to the vane 12. It is to be understood that means other than the spring pins 20 can be used to secure the shear block 14 to the vane 12. For example, an adhesive substance could be used to secure the shear block 14 to the vane 12.

It is also to be understood that the vane 12 and shear block 14 do not have to be a separate construction. The assembly 10 of the vane 12 and shear block 14 could be integral wherein the vane 12 and the shear block 14 form a single member.

The shear block 14 has a general "T" shape, wherein the lower portion 26 of the shear block 14 is received by the recess 16. As the shear block 14 is pushed by the guide slot 64, lateral forces are present on the shear block 14. The lower portion 26 transmits the lateral forces onto the vertical surfaces 18 of the vane 12. The shear block 14 can withstand much larger lateral forces than the pin in the prior art device. This increased shear resistance results from the fact that the shear block 14 has a much larger surface area over which the lateral forces are applied.

The top portion 28 of the shear block 14 is wider than the lower portion 26. The upper 30 and end surfaces 32 of the top portion 28 are curved. This allows the shear block 14 to more easily follow the shape of the guide slot 64. The wide, curved surfaces 30, 32 distribute contact forces more effectively than the shoe surfaces or pin of the prior art device.

The two members 60, 62 that form the guide slot 64 can best be seen in FIG. 6. FIG. 6 shows the guide slot members 60, 62 outside of the axial vane rotary device 34. The two guide slot members 60, 62 are constructed from a single cylindrical member. This cylindrical member is cut in a sine-like pattern to form the two cylindrical guide slot members 60, 62. The interior edges 56, 58 of the cylindrical guide slot members 60, 62 form the guide slot 64. In the prior art device the guide slot members were simply machined into the internal wall of the outer housing. Here, the guide slot members 60, 62 are a separate construction from the outer housing 48. This separate construction makes the guide slot members 60, 62 easier to repair and easier to remove when they are damaged. In addition, the thickness t of the cylindrical guide slot members 60, 62 is greater than the depth of the guide slot in the prior art device. This means that there is less force per square inch being applied to the edges of the guide slot as opposed to the force that was applied to the guide member in the prior art device.

In order to fit the new guide members into the axial vane rotary device, the diameter of the outer housing 48 was increased. The guide slot members 60, 62 are attached to end plates 66, 68 and outer plates 70. The end plates 66, 68, and the outer plates 70 secure the guide members 60, 62 to the outer housing 48 of the axial vane rotary device 34. In operation, the shear block 14 fits snugly between the guide members 60, 62 in a contacting relationship, allowing the guide members 60, 62 to "push" the shear block 14 as the vane rotates.

Although the axial vane rotary device 34 of the present invention has been shown with the guide slot members 60, 62 as a separate construction from the internal wall of the outer housing 48, it is to be understood that the modified vane 12 and shear block 14 assembly 10 could be used with the guide slot machined into the internal wall of the outer housing 48. One would simply machine in a wider slot into the inner wall of the outer housing 48 to accommodate the larger size of the shear block 14 as opposed to the pin of the prior art device.

Figure 7:
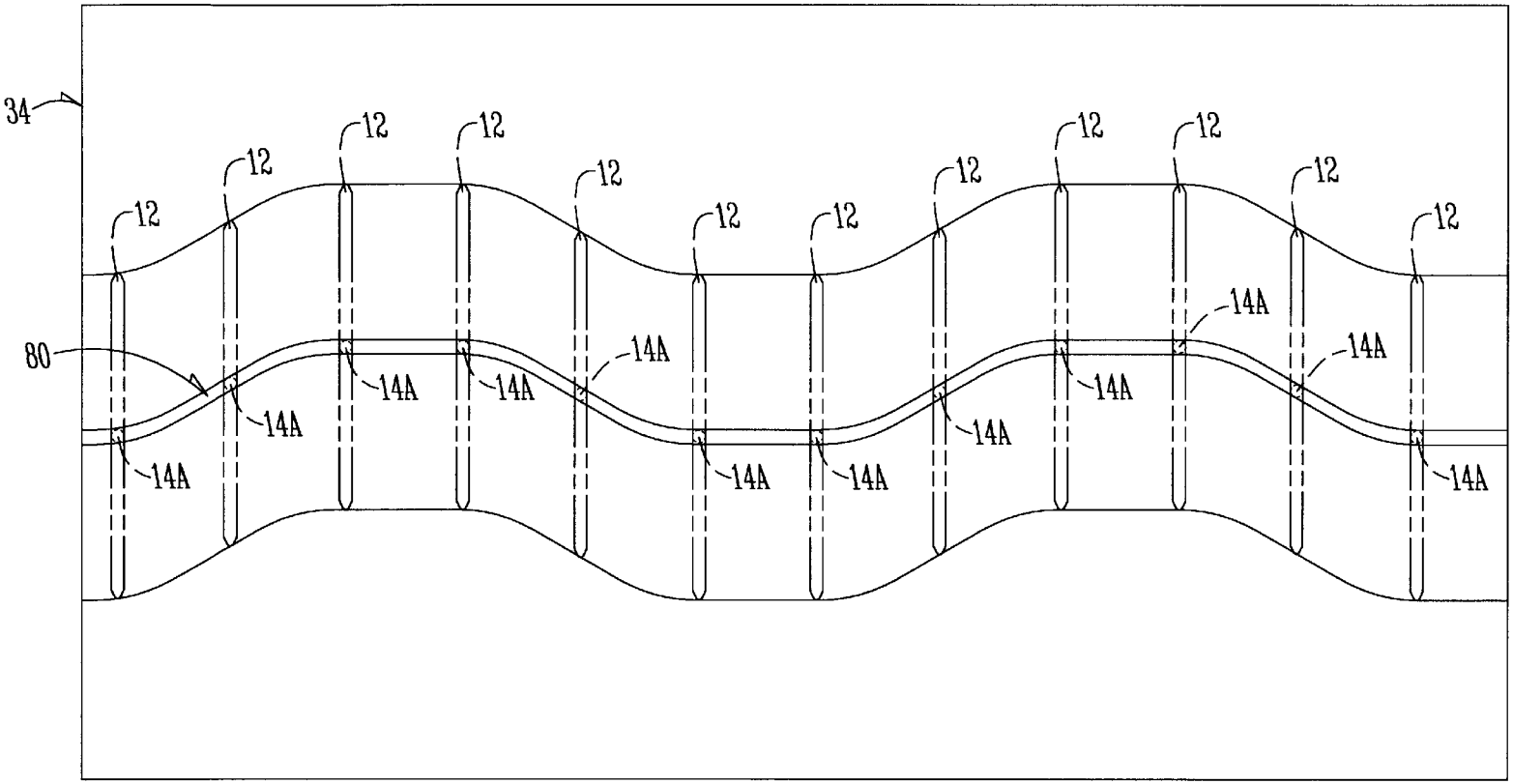
Fig. 7 (Prior Art)
FIG. 7 is an unwrapped view of the vanes as they traverse one revolution within an axial vane rotary device of the prior art.
Figure 8:
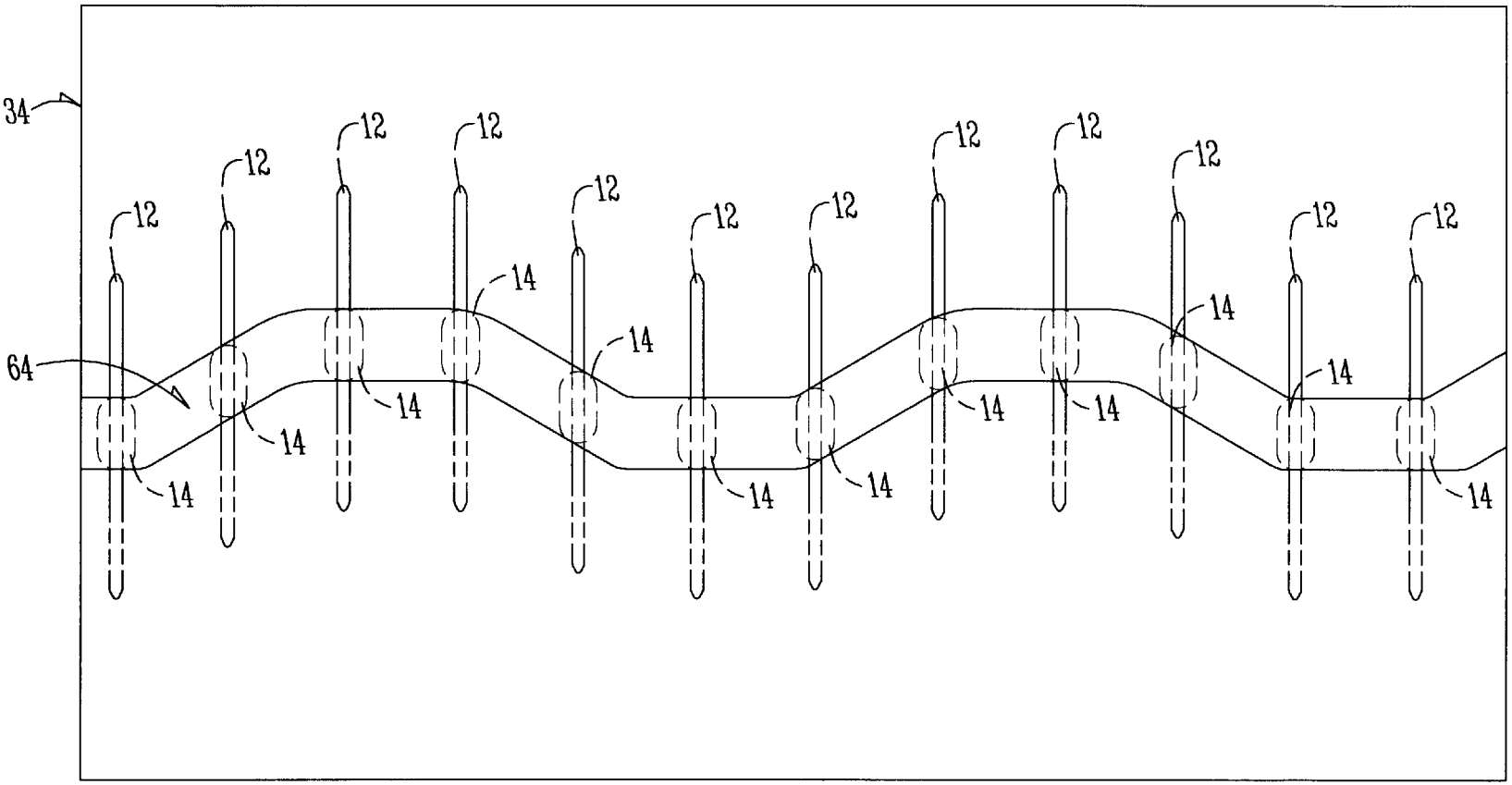
FIG. 8 is an unwrapped view of the vanes as they traverse one revolution within an axial vane rotary device of the present invention.

FIG. 7 is an unwrapped view of the vanes 12 as they traverse one revolution within an axial vane rotary device of the prior art. FIG. 7 shows the pathway formed by the guide member of the prior art device 80. FIG. 8 is an unwrapped view of the vanes as they traverse one revolution within the present invention. As can be seen, the guide member of the prior art device followed a much narrower path 80 than the guide slot 64 of the present invention. The wider path 64 is necessary to accommodate the greater width of the shear block 14.

From the foregoing it can be seen that this invention will achieve at least all of its stated objectives.

In the drawings and specification there has been set forth a preferred embodiment of the invention, and although specific terms are employed, these are used in a generic and descriptive sense only and not for purposes of limitation. Changes in the form and proportion of parts as well as in the substitution of equivalents are contemplated as circumstances may suggest or render expedient without departing from the spirit or scope of the invention as further defined in the following claims.

I claim:

1. An axial vane rotary device having a cylindrical outer housing that defines an internal cylindrical chamber, a rotor core having a drive shaft, the rotor core being rotatably mounted within the internal cylindrical chamber, a plurality of radial slots disposed on the rotor core parallel to the drive shaft centerline, and a cylindrical guide slot held in proper rotational position within the internal cylindrical chamber, the invention comprising:

a plurality of vanes, each having a recess in a top portion of the vane, the vanes being disposed in the radial slots;

and a shear block disposed within the recess of each vane and secured to the vane, at least part of the shear block extending past the top portion of the vane into the guide slot.

2. The axial vane rotary device of claim 1 wherein the shear block has a top portion and a lower portion and is generally T-shaped, and at least part of the top portion of the shear block extends into the guide slot.

3. The axial vane rotary device of claim 2, wherein the top portion of the shear block has an upper surface and end surfaces, and the upper and end surfaces are curved.

4. The axial vane rotary device of claim 2, wherein the vane is composed of a light material.

5. The axial vane rotary device of claim 2, wherein the shear block is composed of a light-weight, shear-resistant and self-lubricating material.

6. The axial vane rotary device of claim 1 wherein the vane and shear block are integral.

7. An axial vane rotary device having a cylindrical outer housing that defines an internal cylindrical chamber, a rotor core having a drive shaft, the rotor core being rotatably mounted within the internal cylindrical chamber, a plurality of radial slots disposed on the rotor core parallel to the drive shaft centerline, and a plurality of vanes, each vane having a guide member, the vanes being disposed in the radial slots, the invention comprising:

two cylindrical guide slot members held in proper rotational position within the internal cylindrical chamber, the two cylindrical guide slot members forming a guide slot, the guide member of each vane partially disposed within the guide slot.

8. The axial vane rotary device of claim 7, wherein the two cylindrical guide slot members are formed by cutting a single cylindrical member into two or more pieces.

9. The axial vane rotary device of claim 7, further comprising:

a recess in the top of each vane;

a shear block, having a top and lower portion, disposed within the recess of each vane and secured to the vane;

and the top portion of the shear block is the guide member and the top portion of the shear block is at least partially disposed in the guide slot.

10. The axial vane rotary device of claim 9, wherein the top portion of the shear block has an upper surface and end surfaces, and the upper surface and end surfaces are curved.

11. The axial vane rotary device of claim 1, wherein the plurality of radial guide slots are comprised of spaces between adjacent rotor end blocks attached to the rotor core.

12. The axial vane rotary device of claim 11, wherein the rotor core and rotor end blocks are integral and not separate parts.

13. The axial vane rotary device of claim 7, wherein the radial plurality of radial guide slots are comprised of spaces between adjacent rotor end blocks attached to the rotor core.

14. The axial vane rotary device of claim 13, wherein the rotor core and rotor end blocks are integral and not separate parts.

* * * * *